United States Patent [19]

Thwaites

[11] Patent Number: 4,782,317

[45] Date of Patent: Nov. 1, 1988

[54] LOW VOLTAGE REJECTION FUSE HAVING AN INSULATING INSERT

[75] Inventor: Clifford J. Thwaites, Mississauga, Canada

[73] Assignee: Gould Inc., Rolling Meadows, Ill.

[21] Appl. No.: 94,177

[22] Filed: Sep. 4, 1987

[51] Int. Cl.[4] ..... H01H 85/16

[52] U.S. Cl. ..... 337/251; 337/165; 337/210

[58] Field of Search ..... 337/161, 162, 163, 164, 337/165, 210, 225, 226, 251, 252

[56] References Cited

U.S. PATENT DOCUMENTS 2,321,711 6/1943 Taylor ..... 337/165

4,344,058 8/1982 Knapp, Jr. et al. ..... 337/173

*Primary Examiner*—H. Broome

*Attorney, Agent, or Firm*—Frederick A. Goettel, Jr.

[57] ABSTRACT

A current limiting cartridge fuse having a portion of restricted diameter in one end cap, which serves as a rejection feature, is provided with an insulating insert which cooperates with the fuse casing and the one end cap to allow an active portion of a short circuit element to be located in the restricted diameter portion of the end cap.

6 Claims, 1 Drawing Sheet

LOW VOLTAGE REJECTION FUSE HAVING AN INSULATING INSERT

BACKGROUND OF THE INVENTION

1. Field of the Invention

This invention relates to current limiting cartridge type fuses having a portion of restricted diameter in one end cap which serves as a rejection feature. A portion of reduced diameter in the cap, when used in conjunction with special fuse holders designed to accept only fuses having such reduced diameter section, prevent the insertion of fuses with inadequate voltage or interrupting ratings in such fuse holders.

2. Description of the Prior Art

Electric cartridge fuses having rejection grooves or portions in one terminal cap are well known in the Prior Art. Such fuses satisfy the requirements of Underwriters Laboratories Class R fuses as well as Canadian Standards Association (CSA) HRC fuses.

A representative electric fuse design which illustrates a fuse having a rejection ferrule is disclosed in U.S. Pat. No. 4,344,058 entitled LOW VOLTAGE CARTRIDGE FUSE DESIGN to Edward J. Knapp, Jr. and Richard J. Perreault and assigned to the assignee of the present invention. In the '058 patent, no active portion of the fusible element extends into the fuse cap region beyond the region of reduced cross-section which defines the rejection feature.

U.S. Pat. No. 2,321,711 entitled FUSIBLE ELECTRIC PROTECTIVE DEVICE to Elmer H. Taylor discloses a dual element cartridge fuse having a centrally positioned overload interrupting portion of the fusible element with short circuit interrupting portions of the fusible element extending from opposite ends of the overload portion to the fuses end ferrules.

The present invention makes possible the incorporation of a dual fusible element arrangement such as that shown in the '711 patent in a cartridge fuse design having an end ferrule which has a rejection groove therein.

SUMMARY OF THE INVENTION

According to the present invention, an electric fuse is provided having an open ended tubular casing of electric insulating material which is closed at one end by a first terminal cap which receives a portion of the tubular casing along its entire axial length. A second terminal cap closes the other end of the casing. The second cap has a portion of restricted diameter in the lateral surface to preclude insertion of the fuse into a fuse holder lacking an interference or rejection member which engages the outside diameter of the portion of restricted diameter. The portion of restricted diameter allows the tubular casing to be received in the rejection terminal cap for only a portion of the axial length of the cap. An elongated fusible element inside the casing conductively interconnects the first and second terminal caps and has an active portion thereof which extends axially along the portion of the second terminal cap which does not receive a part of the tubular casing. An insulating insert is disposed within the tubular casing surrounding at least the portion of the fusible element which extends along the portion of the second terminal which does not receive the tubular casing. The insulating insert comprises the first portion in intimate contact with the open end of the tubular casing and a second portion forming an integral part thereof which extends axially into the portion of restricted diameter of the second terminal cap to thereby provide an insulating barrier between the restricted portion of the second terminal cap and the portion of the fusible element adjacent the portion of restricted diameter of that terminal cap.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENT

Figure 1:
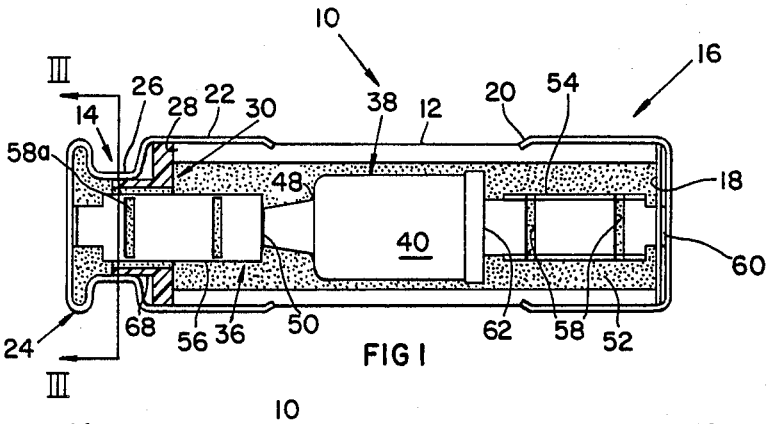
FIG. 1 shows in longitudinal section a complete fuse assembly according to this invention.

Referring now to the drawings in detail, reference numeral 10 refers generally to an electric fuse made according to the present invention. Reference numeral 12 has been applied to indicate a tubular casing of electric insulating material, e.g., a spiral wound paper tube. A pair of terminal caps 14 and 16, close the open ends of the fuse casing 12 at the left and right hand ends thereof respectively. The right hand terminal cap 16 is a standard cap, while the left hand terminal cap 14 is a terminal cap having a rejection feature.

The right hand cap 16 has an inside diameter substantially the same as the outside diameter of the fuse casing 12 and receives the end of the tubular casing which it closes for substantially the entire axial length of the cap 16. In the embodiment illustrated, a slotted brass washer 18 is disposed adjacent the right hand axial end of the fuse casing. The slotted washer 18 serves to facilitate electrical connection of the fusible element with the terminal cap 16 as will be described hereinbelow. The cap 16 is retained on the fuse casing 12 by crimping and dimpling the free end of the terminal cap into the fuse casing material as shown at reference numeral 20.

The left hand, or rejection, terminal cap 14 comprises a main cylindrical section 22 having an inside diameter substantially the same as the outside diameter of the fuse casing and an end section 24 defining the left hand axial end of the fuse and having an outside diameter substantially identical to the outside diameter of the main cylindrical section 22. Situated between the main cylindrical section 22 and the end section 24 of the terminal cap 14 is a portion of restricted diameter 26 which defines the rejection groove or rejection slot of the terminal cap 14.

The construction of the electric fuse 10 as described up to this point is substantially the same as rejection fuses of the type heretofore known in the Prior Art. In such Prior Art fuses, the left hand end 28 of the fuse casing would extend into the rejection terminal cap 14 to the point where it engages the right hand facing portion 30 of the rejection groove 26. The cap 14 would be attached to the fuse casing by a crimping and dimpling operation as described with respect to the right hand end cap 16. Further, in Prior Art rejection fuses of this type, the fusible element typically would extend from the attachment to the right hand end cap 16, as briefly described above, to an attachment at the left hand end 28 of the tube casing 12 wherein one end of the fusible element would typically wrap around the left hand end 28 of the casing to the outside of the casing where it would be electrically connected to the main portion 22 of the rejection cap surrounding the left hand end of the fuse casing. Such an arrangement is shown in the above referenced U.S. Pat. No. 4,344,058. No part of the fusible element would extend into the rejection terminal cap 14 beyond the left hand end 28 of the fuse casing 12.

The present invention departs from this conventional construction by provision of an insulating sleeve, or insert 30 which includes a first portion 32, in initmate contact with the left hand end 28 of the casing, and a second portion 34 of reduced diameter extending axially into the portion of restricted diameter 26 of the rejection terminal cap 14.

Before proceeding with the detailed description of the insulating insert 30, the fusible element 36 of the illustrated embodiment will be described.

Figure 2:
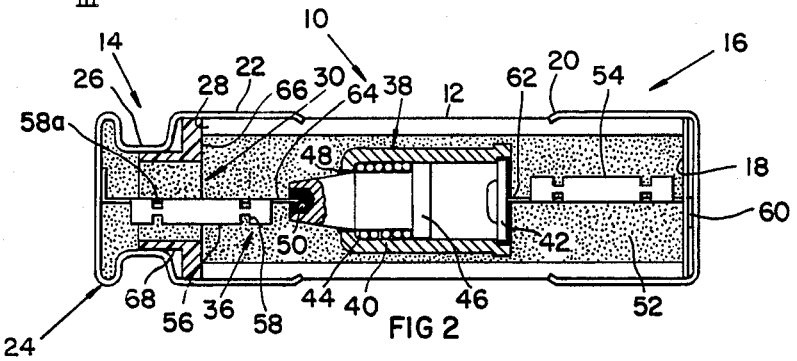
FIG. 2 shows a longitudinal section of the fuse of FIG. 1 rotated 90 degrees and partially broken away to show the details of the overload interrupting portion of the fusible element.
Figure 3:
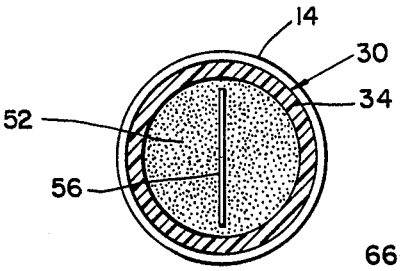
FIG. 3 is a cross-section along III—III of FIG. 1.
Figure 4:
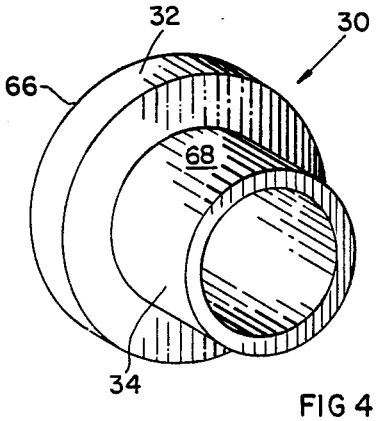
FIG. 4 is an enlarged perspective view of the insulating insert of the present invention.

With reference now to FIGS. 1 and 2, reference numeral 38 has been applied to generally indicate the low-current interrupting means of the fuse. The low current interrupting means comprises a tubular spring enclosure 40 made of metal and arranged inside of the fuse casing 12 in the center region thereof. The right side of the spring enclosure 40 is closed by a disc-shaped metal cover 42. A helical spring 44 is arranged inside of the space bounded by the spring enclosure 40. The spring 44 acts upon the flange of a plunger 46. One end of the plunger 46 is positioned inside of the enclosure 40. The spring 44 biases the plunger 46 to further move the plunger into the spring enclosure 40. The housing, spring, and plunger are arranged in coaxial relation. The structure further includes a pair of solder joints 48, 50. Solder joint 48 normally maintains the plunger 46 in position against the bias of the spring 44. Solder joint 50 is arranged on one end surface of the plunger 46 for electrically connecting the plunger 46 to a short circuit fuse link. The fuse casing 12 is filled with a pulverulent arc-quenching filler 52, in which the above described low current interrupting structure is immersed.

The fusible element 36 further includes a pair of ribbon fuse link sections 54, 56 for interrupting short circuit currents, which are also immersed in the pulverulent arc-quenching filler 52.

Each of the ribbon fuse link sections 54, 56 contain several regions of reduced cross sectional area 58 along the length thereof adapted to fuse to interrupt the circuit when traversed by short-circuit-like currents.

The right hand short circuit fuse link section 54 is attached to the inner face of the right hand fuse cap 16 by means of a right angled tab 60 which extends through the slotted washer 18. The slotted washer serves both to center the fuse link within the fuse casing as well as facilitating soldering of the tab 60 as it is trapped in a space defined between the slotted washer 18 and the inside end of the right hand fuse cap 16. The left hand end 62 of the short circuit section 54 is soldered to the disc-shaped cover 42 of spring enclosure 40 in a conventional manner.

The left hand short circuit fuse link section 56 is attached by solder joint 50 to the outside end of the movable plunger 46 as mentioned above. As is evident from the drawing figures, the left hand short circuit fuse link extends from the solder joint 50 to the left along the length of the fuse casing through the insulating insert 30, along the entire length of the rejection ferrule 14 where it terminates in a reduced cross section tab 64 which is soldered to the inside end surface of the rejection ferrule. It will be noted that the left hand short circuit interrupting section 56 is substantially identical in dimensions to the right hand short circuit section 54. As a result, one of the regions of reduced cross section 8*a* of the short circuit link 56 extends through the reduced diameter region 26 of the rejection ferrule 14.

The insulating insert 30 of the present invention as mentioned above, includes a first portion 32 in intimate contact with the left hand end 28 of the fuse casing 12. The first portion comprises a relatively narrow cylindrical section having an outside diameter substantially equal to the outside diameter of the fuse casing and an inside diameter which is less than the diameter 26 of the rejection terminal cap 14.

The second portion 34 of the insulating insert 30 has an inside diameter substantially equal to the inside diameter of the first cylindrical section and an outside diameter substantially equal to the inside diameter of the portion of reduced diameter 26 of the rejection terminal cap 14.

As best shown in FIGS. 1 and 2, the first portion 32 of the insert defines a right hand facing annular surface which forms a sealing contact with the left hand end 28 of the casing 12 and with the inside surface of the main section 22 above the rejection terminal cap 14. The second portion 34 extends with its outside surface 68 in a close-fit relationship with the inner surface of the portion of restricted diameter 26 of the terminal cap 14.

The insulating insert 30 as thus described cooperates with the end surface 28 of the fuse casing 12 and the inner surfaces of the rejection end cap 14 to define an axial extension of the fuse casing well into the restricted diameter section 26 of the rejection end cap 14. The thickness of the insulating insert 30 and its depth of extension into the end cap is selected such that it provides an electrically insulating barrier to prevent arcing from the region of reduced cross sectional area 58*a* of the portion of the short circuit link extending through the insulating insert to the region of reduced cross section of the rejection terminal cap. The pulverulent arc-quenching filler 52 contained within the fuse casing extends into the reduced diameter defined by the insulating insert and into the end section 24 of the rejection terminal cap 14 as well, to completely surround the short circuit link 56.

In the preferred embodiment, the insulating insert 30 is a one-piece element formed from a hard white nylon material selected to withstand the operating temperatures of the fuse and to provide the necessary dielectric properties to properly insulate the short circuit element from the region of reduced diameter of the rejection terminal cap. Other insulating materials having comparable properties obviously could be substituted for nylon in practicing the present invention.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

What is claimed is:

1. An electric fuse comprising:

(a) a tubular casing of electric insulating material, said casing having a first open end at one axial end thereof and a second open end at the other axial end thereof;

(b) a first terminal cap receiving the portion of said tubular casing adjacent said first open end along substantially the entire axial length of said first cap to close said first open end of said casing;

(c) a second terminal cap closing said second open end of said casing, said second terminal cap having a portion of restricted diameter in the lateral surface thereof, situated between the axially inner end and the end surface thereof to preclude insertion of the fuse into a fuse holder lacking an interference member engaging the outside diameter of said portion of restricted diameter; said second terminal cap receiving the portion of said tubular casing adjacent said second open end, said portion of restricted diameter allowing said tubular casing to be received in said second terminal cap for only a portion of the axial length of said second terminal cap;

(d) an elongated fusible element inside said casing, said fusible element conductively interconnecting said first and second terminal end caps and having a portion thereof extending axially along the portion of said second terminal cap not receiving said tubular casing; and (e) an insulating insert disposed within said tubular casing and surrounding at least said portion of said fusible element extending along the portion of said second terminal not receiving said tubular casing, said insulating insert comprising a first portion in intimate contact with said second open end of said tubular casing and and a second portion forming an integral part thereof extending axially into the portion of restricted diameter of said second terminal cap to thereby provide an insulating barrier between said restricted portion of said second terminal cap and the portion of said fusible element adjacent said portion of restricted diameter.

2. The electric fuse of claim 1 wherein said insulating insert is made from nylon.

3. The electric fuse of claim 1 wherein said first portion of said insulating insert comprises a first cylindrical section having an outside diameter substantially equal to the outside diameter of said tubular casing and an inside diameter less than the diameter of said portion of restricted diameter.

4. The electric fuse of claim 3 wherein said second portion of said insulating insert comprises a second cylindrical section having an inside diameter substantially equal to the inside diameter of said first cylindrical section and an outside diameter substantially equal to the inside diameter of said portion of reduced diameter of said second terminal cap.

5. The electric fuse of claim 4 wherein said insulating insert is made from nylon.

6. The electric fuse of claim 1 wherein said portion of said elongated fusible element extending axially along the portion of said second terminal cap not receiving said tubular casing comprises a region of reduced cross-sectional area comprising at least a part of the short circuit interrupting portion of said elongated fusible element.

* * * * *